US010428486B2

(12) United States Patent
Ferraiolo

(10) Patent No.: US 10,428,486 B2
(45) Date of Patent: Oct. 1, 2019

(54) ANCHORING MEMBER FOR FACING ELEMENTS FOR USE IN STABILISED EARTH STRUCTURES, FORMER AND PROCEDURE FOR THE FABRICATION OF SUCH A FACING ELEMENT

(71) Applicant: OFFICINE MACCAFERRI S.P.A., Zola Predosa, Bologna (IT)

(72) Inventor: Francesco Ferraiolo, Ca' de' Fabbri BO (IT)

(73) Assignee: OFFICINE MACCAFERRI S.P.A., Zola Predosa (BO) (IT)

( * ) Notice: Subject to any disclaimer, the term of this patent is extended or adjusted under 35 U.S.C. 154(b) by 0 days.

(21) Appl. No.: 15/555,778

(22) PCT Filed: Mar. 9, 2015

(86) PCT No.: PCT/IB2015/051706
§ 371 (c)(1),
(2) Date: Sep. 5, 2017

(87) PCT Pub. No.: WO2016/142739
PCT Pub. Date: Sep. 15, 2016

(65) Prior Publication Data
US 2018/0044879 A1 Feb. 15, 2018

(51) Int. Cl.
*E04G 21/14* (2006.01)
*E02D 29/02* (2006.01)
*B28B 1/14* (2006.01)
*B28B 23/00* (2006.01)

(52) U.S. Cl.
CPC ..... *E02D 29/0266* (2013.01); *B28B 1/14* (2013.01); *B28B 23/005* (2013.01); *E02D 29/0233* (2013.01); *E04G 21/142* (2013.01)

(58) Field of Classification Search
CPC ..... E04G 21/142; E04B 1/38
USPC ..... 249/176, 177; 405/262, 284, 286; 52/125.1–125.5
See application file for complete search history.

(56) References Cited

U.S. PATENT DOCUMENTS 5,839,855 A * 11/1998 Anderson ..... E02D 29/0225 405/262
7,743,580 B2 * 6/2010 DeLoach, Sr. ..... E04B 1/41 52/659
8,024,896 B2 * 9/2011 Azarin ..... B28B 23/005 52/125.1

(Continued)

FOREIGN PATENT DOCUMENTS

DE 3633633 A1 * 6/1988

OTHER PUBLICATIONS

International Search Report issued in Application No. PCT/IB2015/051706 dated Nov. 3, 2015 (3 pages).

(Continued)

*Primary Examiner* — Sunil Singh
(74) *Attorney, Agent, or Firm* — Flynn Thiel, P.C.

(57) ABSTRACT

An anchoring member (15) capable of being integrated into a facing element (10) for the creation of stabilized earth structures, comprising a shell (21) that defines a recess (18) with a mouth (13). An anchoring bar (20) extends transversely within the recess (18) in such a way that, in use, an elongated stabilizing member for stabilized earth structures, such as a strip or similar, can be made to pass around it by inserting it into the mouth (13).

13 Claims, 5 Drawing Sheets

(56) References Cited

U.S. PATENT DOCUMENTS

| | | | | |
|---|---|---|---|---|
| 9,523,178 | B2 * | 12/2016 | Ferraiolo | E02D 5/80 |
| 2003/0140576 | A1 * | 7/2003 | Sanftleben | E04G 15/04 52/125.4 |
| 2018/0195251 | A1 * | 7/2018 | Freitag | E02D 29/0241 |

OTHER PUBLICATIONS

Written Opinion of the International Searching Authority issued in Application No. PCT/IB2015/051706 dated Nov. 3, 2015 (5 pages).
Notification of Transmittal of International Preliminary Report on Patentability issued in Application No. PCT/IB2015/051706 dated Jul. 12, 2017 (1 page).
International Preliminary Report on Patentability issued in Application No. PCT/IB2015/051706 dated Jul. 12, 2017 and 408 reply thereto dated May 22, 2017 (6 pages).

* cited by examiner

ANCHORING MEMBER FOR FACING ELEMENTS FOR USE IN STABILISED EARTH STRUCTURES, FORMER AND PROCEDURE FOR THE FABRICATION OF SUCH A FACING ELEMENT

SCOPE OF THE INVENTION

The present invention concerns the anchoring of panels used in the facing of stabilised earth structures. In particular, the invention concerns an anchoring member for a facing element of a stabilised earth structure. The invention also concerns a facing element comprising at least one such anchoring member, and the method for fabricating such a facing element.

TECHNOLOGICAL BACKGROUND

A stabilised earth structure is a structure used for creating retaining walls, embankments, abutments for bridges or the like. In the stabilised earth structure, it is known to embed stabilising members in a substrate of earth, so as to obtain an earth structure that is stabilised overall thanks to the friction of the earth on the stabilising members. In some known solutions, the stabilising members are in the form of elongated strips. The stabilised earth structure is delimited by facing elements, normally prefabricated, butted against one another and provided on their rear face with anchoring members to which are fixed the extremities of the strips constituting the stabilising members of the stabilised earth structure.

Anchoring members are known that are constructed using shaped metal reinforcing rods, partially drowned in the concrete from which the facing elements are fabricated. These metal rods are bent in such a way as to form a ring or eyelet that protrudes from the rear face of the facing element and through which the stabilising member is made to pass. In some cases, anchoring members have been created that comprise pairs of rings protruding from the rear face of the facing element, within which is inserted a cylinder around which, in turn, the stabilising member is made to pass. This construction is extremely laborious and requires adequate practical skill for the correct creation of the anchoring members. In addition, the fact that the anchoring members protrude from the rear face of the facing elements renders them subject to impacts and makes it impractical to stack the facing elements on top of one another for transport. These protruding anchoring members created from metal rod are also subject to corrosion.

U.S. Pat. No. 5,839,855 shows a method for creating C-shaped recesses in the rear face of the facing element, into which to insert the stabilising members. It is notable that there are no anchoring members protruding from the rear of these facing elements. However, the creation of the C-shaped recesses as described and illustrated in U.S. Pat. No. 5,839,855 is particularly complex and expensive both in terms of time and in terms of the need for qualified personnel who know how to position and extract from the concrete the cores used for creating the undercut C-shaped recesses.

The aim of the present invention is to solve the problems of the prior art, and in particular the problem of creating a facing element for stabilised earth structures with an anchoring system that is economical and simple to produce, as well as being reliable and secure in use.

SUMMARY OF THE INVENTION

In order to achieve the aims indicated above, the present invention concerns an anchoring member capable of being integrated into a facing element for the creation of stabilised earth structures. The anchoring member comprises a shell that defines a recess with a mouth. An anchoring bar extends transversely within the recess in such a way that, in use, an elongated stabilising member, such as a strip or similar, can be made to pass around it by inserting it into the mouth of the anchoring member.

The anchoring member thus created is simple to incorporate into a facing element during its fabrication, requires no additional operations to remove it when the concrete of the facing element has set, and is also extremely economical.

According to another aspect of the invention, the anchoring bar of the anchoring member is tubular, so as to allow, in use, the insertion inside it of a rod element of a reinforcing grid. In this way, the resistance to the pull exerted on the anchoring bar by the elongated stabilising member of the stabilised earth structure is exerted by the metal rod that forms part of the reinforcing grid, connected in a mesh structure to other metal rods within the concrete work.

According to another aspect of the invention, the anchoring bar is made of a piece with the shell, in order to produce a compact and economical structure, easily manufactured at low cost in large quantities, for example by moulding or injection of plastic materials.

According to another aspect of the invention, the anchoring bar is a separate tubular element, which is inserted into two opposing holes provided on the sides of the shell. The manufacture of such an anchoring member is extremely simple and economical.

According to another aspect of the invention, the extremities of the tubular element protrude laterally outside the shell. This protrusion can serve as a support for a rod of the reinforcing grid. This also makes it possible to provide sealing rings seals fitted on to the tubular element against the inner and outer sides of the shell, so as to eliminate or reduce any passage of concrete between the exterior and the interior of the shell.

According to another aspect of the invention, the mouth of the anchoring member is delimited peripherally by a protruding frame so as to form a peripheral supporting step, so that it can be supported in a former during the process of fabricating the facing element.

According to another aspect of the invention, the mouth of the anchoring member comprises housing means for a lid, in order to prevent the recess of the anchoring member from becoming blocked up during the fabrication of the concrete work.

According to another aspect of the invention, the shell is defined by a constant-section curved wall, essentially in the shape of a U, a C or a V with rounded apex, delimited at its extremities by two flat side walls. Such a shape is simple to create, and convenient and ergonomic in use.

The invention also concerns a facing element for a stabilised earth structure, comprising a visible front face and a rear face which in use is positioned in contact with a mass of earth. On the rear face is provided at least one recess with a mouth, and an anchoring bar extends transversely within the recess in such a way that, in use, an elongated stabilised earth structure stabilising member can be made to pass around it by inserting it into the mouth.

According to a particular aspect of the invention, the recess is defined by the shell and by an anchoring member as previously mentioned, which is incorporated within the facing element in such a way that its mouth is essentially in line with the rear face of the facing element.

According to another aspect of the invention, within the facing element is embedded a reinforcing grid consisting of rods that form a mesh. The anchoring bar of the anchoring member is tubular, and at least one of the rods of the grid is inserted into the tubular anchoring bar.

The invention also concerns a former for the fabrication of a facing element as previously mentioned, incorporating one or more members of the type described above. The former comprises positioning and support members to support the one or more anchoring members in a spatial position.

According to a specific aspect, the positioning and support members comprise at least one pair of bars supported on edges of the former. The pair of bars is provided with a respective series of holes for the selective positioning of supporting plates for the one or more anchoring members.

Finally, the invention also concerns a procedure for the fabrication of a facing element of the type mentioned above, incorporating one or more anchoring members of the type indicated, using a former as indicated above. The procedure comprises the following steps:

preparing the former;

inserting into the former a reinforcing grid consisting of rods that form a mesh, at least one of the said rods being inserted into the anchoring bar, produced in tubular form, of at least one of the one or more anchoring members;

supporting the one or more anchoring members by means of positioning and support members fitted on to the former;

pouring fluid concrete into the former;

waiting for the concrete to set in the former;

removing the positioning and support members; and removing the finished facing element from the former.

BRIEF DESCRIPTION OF THE DRAWINGS

Further characteristics and advantages will become evident from the detailed description that follows of a preferred embodiment of the invention, with reference to the annexed drawings, supplied purely by way of non-limitative example, in which.

DETAILED DESCRIPTION OF A PREFERRED EMBODIMENT

Figure 1:
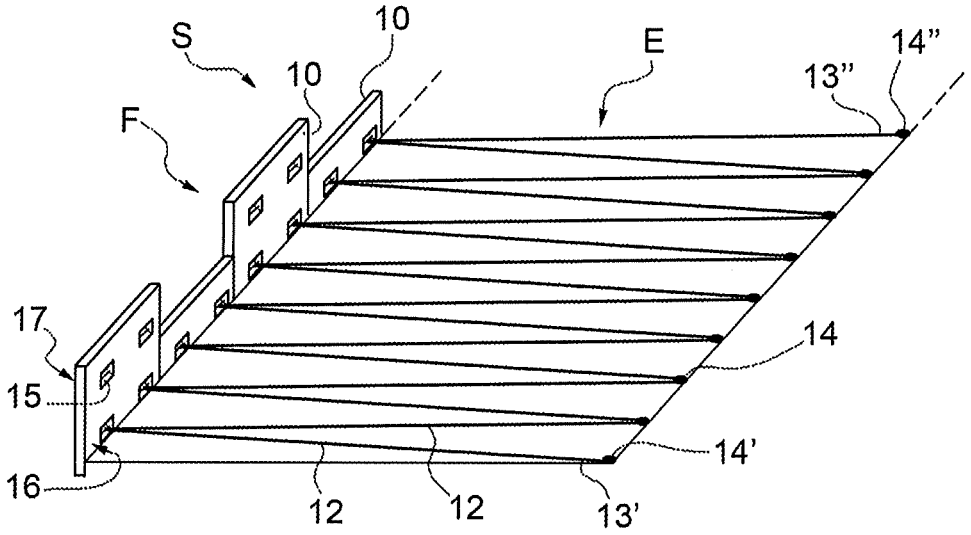
FIG. 1 shows a schematic representation of a stabilised earth construction site.

FIG. 1 shows a schematic representation of a stabilised earth construction site S in which an anchoring system according to the present invention is used to anchor facing elements 10 of a stabilised earth structure E. The facing elements 10, which are preferably prefabricated from concrete, are placed side by side and successively overlapped with one another to form the facing F of the stabilised earth structure E. The shape, design and specific reciprocal positioning of the facing elements 10 may vary according to the specific choice of the panels used. The choice of the shape and layout of the panels is known in the industry and does not fall within the scope of the present invention.

The earth is stabilised by a plurality of elongated stabilising members 12 which extend behind the facing F into a mass of earth. In the example of FIG. 1, the stabilising members 12 are formed by a single strip element which has a first extremity 13' attached to an initial earth anchoring pin 14' and which runs in an alternating zig-zag fashion between anchoring members 15 placed on the rear face of each facing element 10 and intermediate earth anchoring pins 14, to a final earth anchoring pin 14" to which is attached the other extremity of the strip element. Naturally, the stabilising members 12 may also consist of strips independent from one another, with one extremity attached to the respective earth anchoring pin and the other extremity attached to the respective anchoring member 15 on the rear of the facing element 10.

In greater detail, each anchoring member 15 is integrated into the rear face 16 of a panel 10, opposite a front face 17 which contributes to the formation of the true and proper face F of the stabilised earth structure E, i.e. the side that remains almost always visible in the completed work. For simplicity, FIG. 1 shows panels 10 in which only a single anchoring member is provided at each predetermined height in a configuration of alternately offset panels 10.

The number and position of the anchoring members 15 on the rear face 16 of each panel may naturally differ from as shown, and may be adapted to each specific requirement according to the project, the construction site, the dimensions and shape of the facing elements, their reciprocal positioning (e.g. staggered, lined up, overlapped, etc.) and the like.

Figure 2:
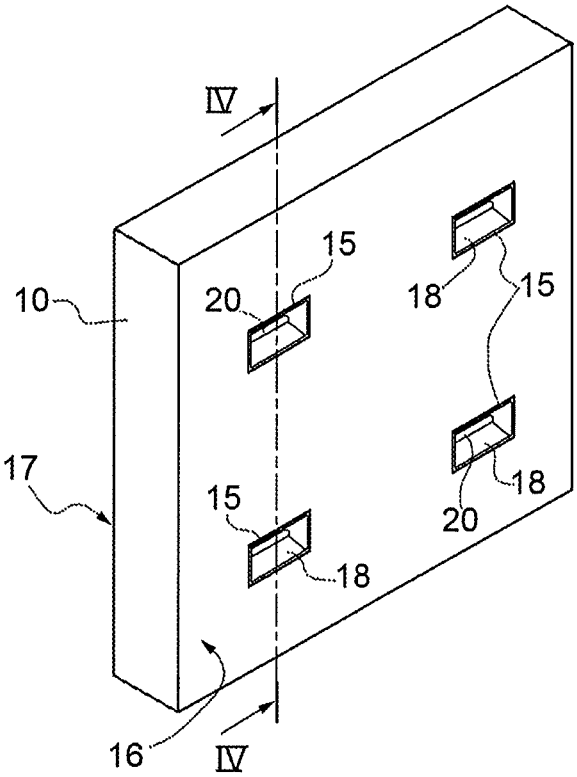
FIG. 2 shows a perspective view of an example of a facing element according to the present invention.
Figure 3:
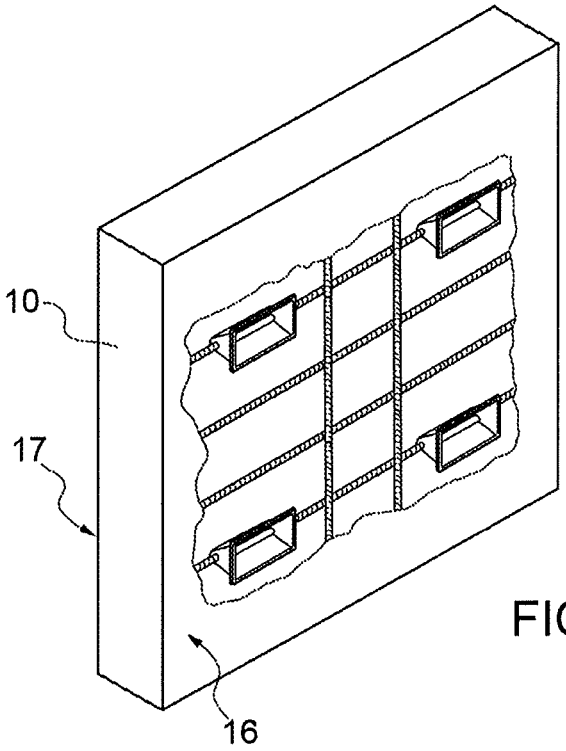
FIG. 3 shows a partial cross-section of the facing element of FIG. 2, in which a portion of the reinforcing grid is visible.
Figure 4:
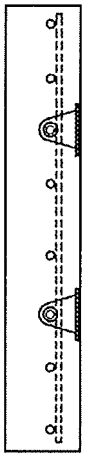
FIG. 4 shows a transverse cross-section of the facing element along the line IV-IV of FIG. 2.

FIGS. 2 to 4 show a facing element 10 provided with anchoring members 15 that form respective recesses or niches 18 on the rear face 16. The recesses 18 are passed through by an anchoring bar 20 around which, in use of the facing element 10, it is possible to wrap or attach a stabilising member 12 of the strip type, as shown in FIG. 1. In the example shown in the drawing, the facing element 10 is provided with four anchoring members 15 arranged in a square, in side-by-side overlapping pairs. Naturally, this is only an illustrative example of the principle of the invention, since in practice the number and arrangement of the anchoring members 15 on the facing element 10 can be varied as desired, according to the needs of use and the design characteristics of the stabilised earth structure.

Figure 5:
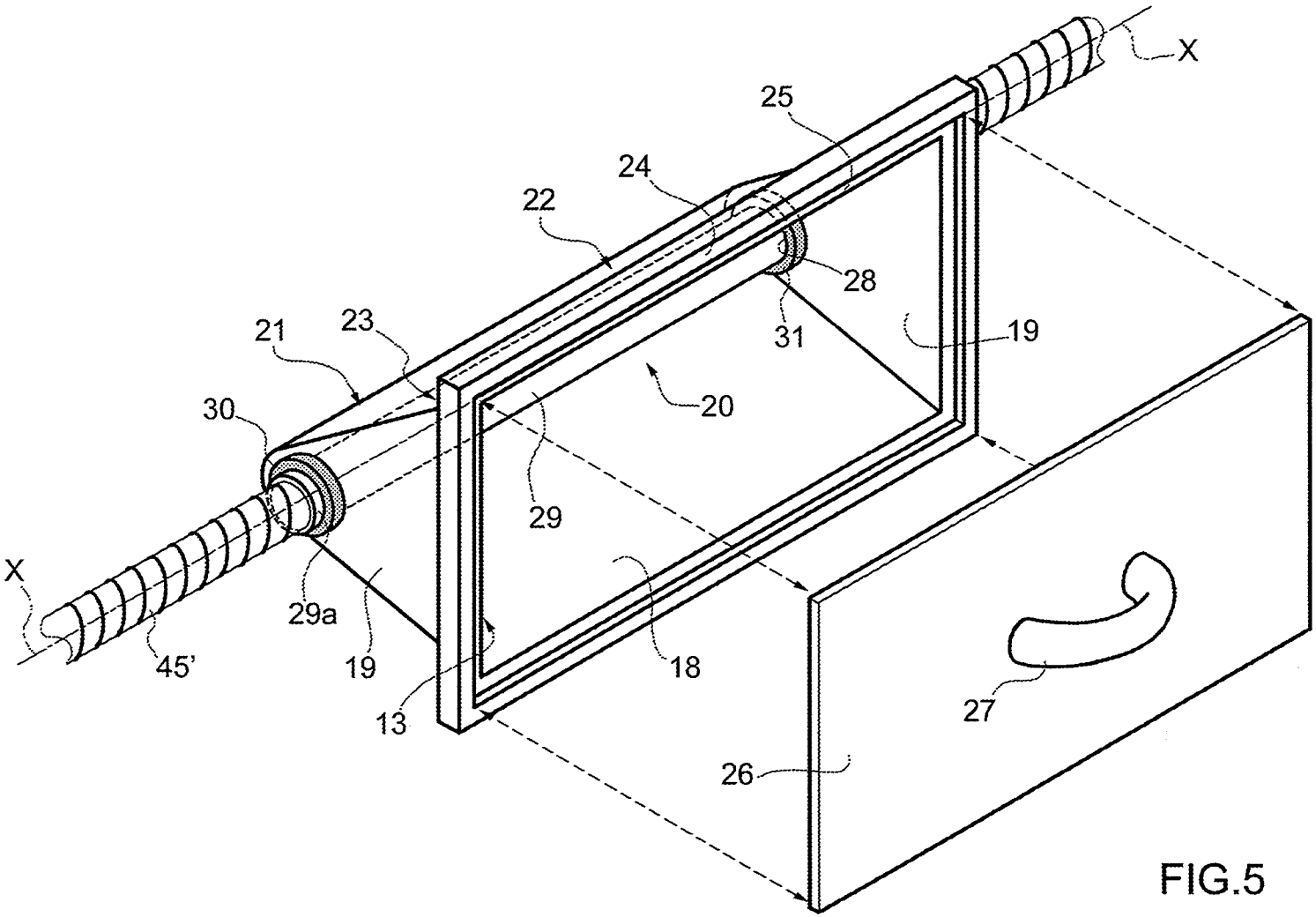
FIG. 5 shows a perspective view of an anchoring member according to the present invention.

In greater detail, as can also be seen in FIG. 5, an anchoring member 15 comprises a shell 21 defined by a constant-section curved wall, essentially in the shape of a U, a C or a V with rounded apex, delimited at its extremities by two flat side walls 19, preferably flat. In the shell 21 is thus defined a mouth 13 giving access to the internal recess 18. The mouth 13 of the shell 21 is delimited on its perimeter by a protruding frame 22 that forms a peripheral supporting step 23. On the frontal area 24 of the frame 22 is provided a step 25 within which can be housed a jointed lid 26 provided with a handle 27, whose function will become clearer below.

In the side walls 19 are provided two respective holes 28, aligned along a common axis X-X essentially parallel with the plane of the mouth 13 and the step 22. The anchoring bar 20 is formed by a tubular element 29 inserted into the holes 28 in such a way that its extremities 29*a* protrude outside the side walls 19 of the shell 21. The external diameter of the tubular element 29 is essentially equal to or slightly smaller than the diameter of the holes 28. Two pairs of external sealing rings 30 and internal sealing rings 31 are inserted to form a seal on the tubular element 29. The external sealing rings 30 and internal sealing rings 31 are respectively in contact with the external and internal faces of the side walls 19 of the shell 21, and serve to close any passages between the outside of the shell 21 and the recess 18, for reasons that will become clearer below.

Figure 6:
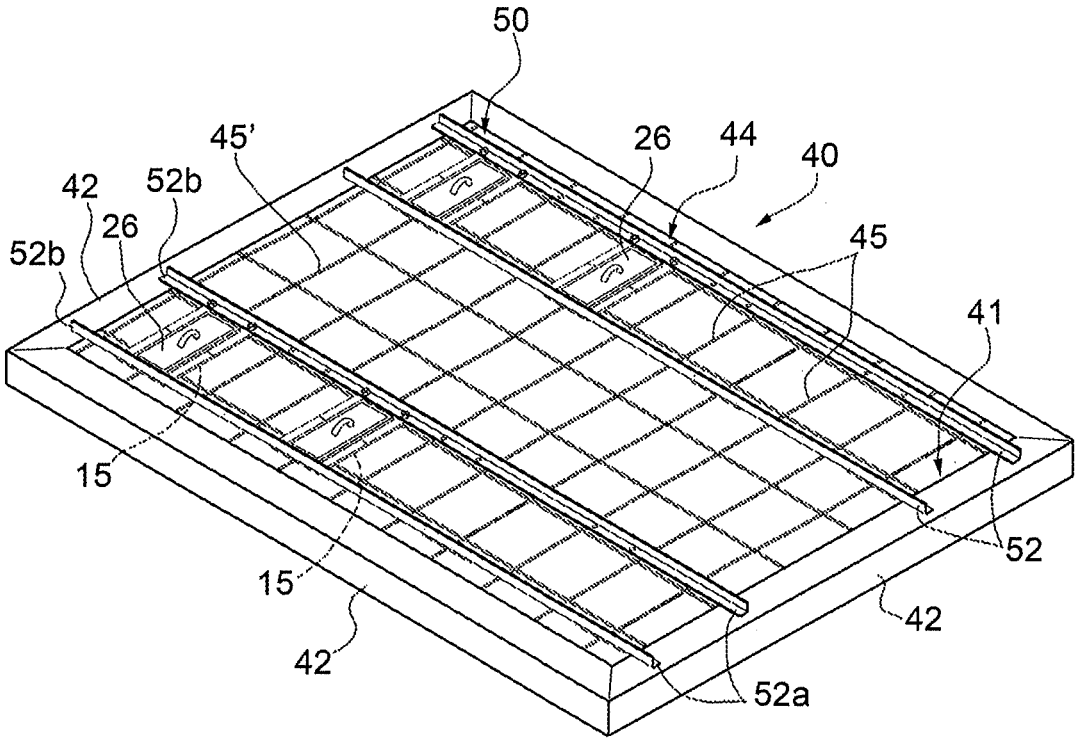
FIG. 6 shows the positioning of anchoring members, provided with lids, in a former for the fabrication of a facing element.

As can be seen in FIG. 6, for creating a facing element 10 a former 40 is provided, comprising a flat or shaped former base 41, for example in accordance with the impression created on the front face 17 of the facing element 10. The sides 42 of the former 40 may be flat, in order to obtain smooth edges of the facing element 10, or may, as known, have prominences in order to create bends on the edges of the facing element 10 to facilitate the jointing of the panels alongside one another. Purely by way of example, the former shown in FIG. 6 is rectangular, but may naturally also take any shape in order to obtain corresponding facing elements of a shape other than rectangular. Within the former is placed a metal reinforcing grid 44 formed, as known, by metal rods 45. On one or more metal rods 45' of the metal grid 44 are fitted one or more corresponding anchoring members 15, inserting the metal rod 45' into the tubular element 29. The metal rod 45' preferably has a diameter smaller than the internal diameter of the tubular element 29. As can be seen in the non-limitative example of FIG. 6, on a given metal rod 45' may also be fitted two or more anchoring members 15, which are closed by respective lids 26.

Figure 7:
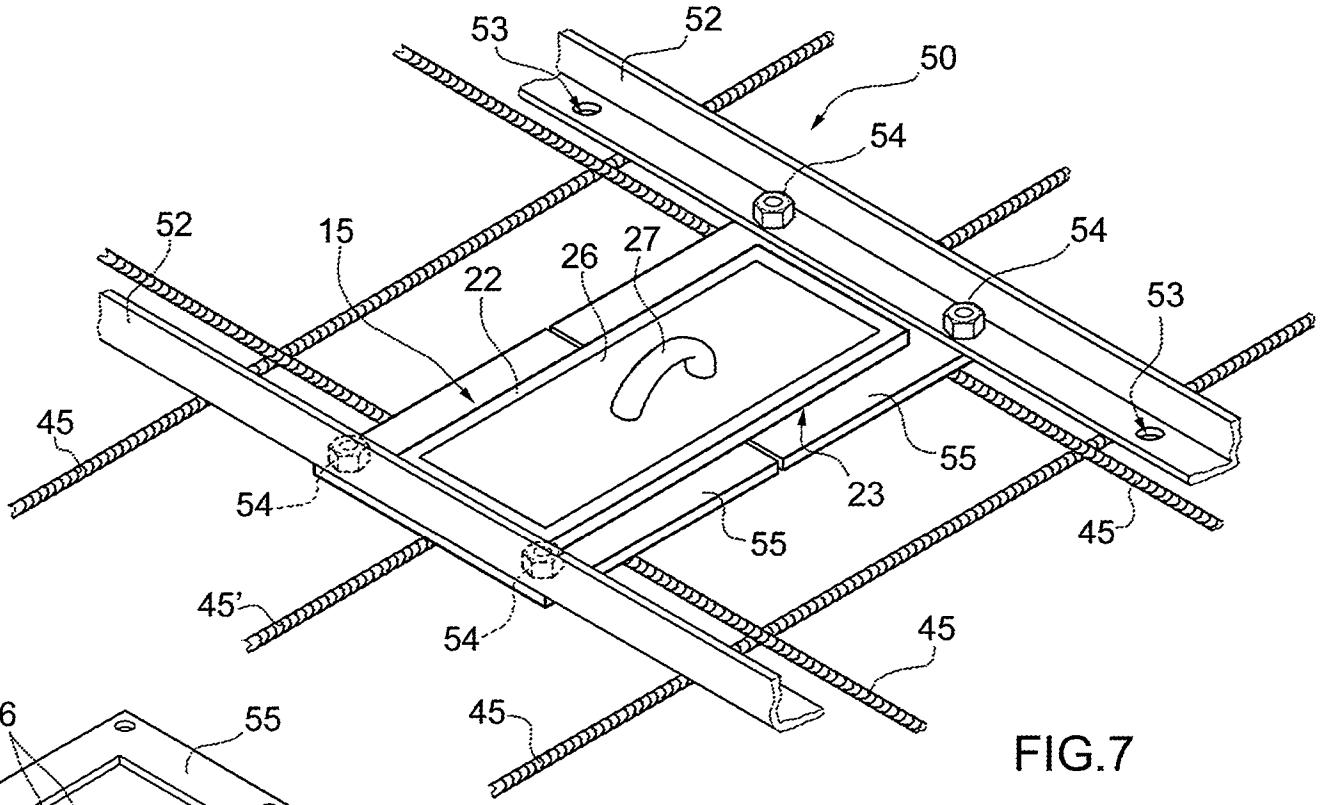
FIG. 7 shows on an enlarged scale a detail of the support of the anchoring members in the former of FIG. 6.
Figure 8:
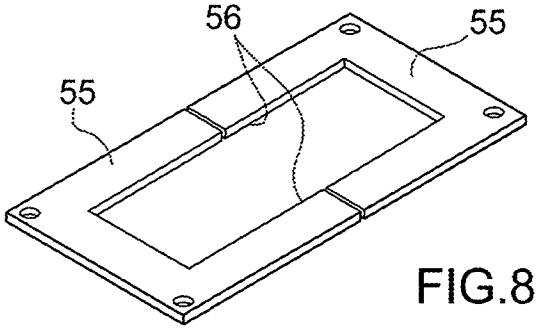
FIG. 8 shows a schematic representation of the support plates of the anchoring member in the former of FIG. 6.

On the former 40 are then arranged positioning and support elements 50 to hold the anchoring members 15 in the desired position at such a height with respect to the former base 41 that their mouths 13 are, on completion of the fabrication of the facing element 10, essentially in line with its rear face 16. As can be seen more clearly in the detail of FIG. 7, the positioning and support elements 50 preferably comprise a pair of support bars 52, which in the non-limitative example in the drawings have an L-shaped cross-section, whose extremities 52*a*, 52*b* are supported on and attached to the sides 42 of the former 40 (FIG. 6). On each support bar 52 is provided preferably a series of regularly spaced holes 53 for the fitting, by means of bolts 54, of two opposing support plates 55, in the desired position on the support bar 52. The two support plates 55 are preferably C-shaped, as can be seen in FIG. 8, so as to define together a rectangular housing 56 for the shell 21 of an anchoring member 15. The dimensions of the housing 56 formed by the coupling of the support plates 55 are such that the protruding frame 22 of the anchoring member is braced against the support plates 55 thanks to its perimetric supporting step 23.

Once the former has been prepared with the reinforcing grid 44 and the anchoring members 15 correctly positioned and held up by the positioning and support members 50, the necessary concrete is poured into the former 40 to form a facing element 10. In particular, the concrete is poured up to a level almost corresponding to the height at which the step 22 of the anchoring members 15 is positioned.

The support plates 55 may be covered by the concrete, and therefore remain embedded in the facing element 10 after setting has taken place. Alternatively, the concrete is poured until it just touches the support plates 55, which are then removed after setting has taken place, together with the support bars 52.

The lids 26 protect the recesses 18 of the anchoring members 15, preventing them from being even partially obstructed during the pouring of the concrete. Once the concrete work has set, the lids 26 are removed to uncover the recesses 18 of the anchoring members 15 and the anchoring bars inside them. If the pouring of the concrete is limited to the point of just touching the support plates 55 without covering them, it may also be acceptable to do without the lids 26, since the risk of obstructing the recesses 18 with the poured concrete is limited. In this case, there would be a proportional reduction in the unit cost of the anchoring members 15 devoid of lids.

The metal rods 45' inserted into the tubular elements 29 of the anchoring members 15 hold the anchoring members 15 in position during the pouring of the concrete, preventing them from being lifted by flotation. In addition, the metal rods 45' are also the elements that provide adequate resistance for the anchorage of the facing elements 10 via the strip-form stabilising members 12, which are wrapped around the tubular elements 29 during the creation of the stabilised earth structure.

The two pairs of external sealing rings 30 and internal sealing rings 31 prevent or substantially limit the penetration of concrete, or of water mixed with cement, into the recess 18 of the anchoring member 15 during the pouring of the concrete and the subsequent setting phase. On the other hand, it is possible that a more or less significant quantity of concrete may penetrate into the inside of the tubular element 29 during the pouring, especially if the diameter of the metal rod 45' is substantially smaller than the internal diameter of the tubular element 29. This does not constitute a drawback, but may even make a contribution, in some cases, to improved stabilisation of the anchoring member on the metal rod 45' and improved resistance of the anchoring bar 20 in the use of the facing element 10.

The anchoring member 15 may be made from economical materials such as plastic, since the resistance of the anchorage in the use of the facing element 10 is provided by the resistance of the rod 45' that runs inside the tubular element 29, with a possible contribution from the poured concrete inside it.

The particular shape of the shell 21 shown in the drawings should not be understood to be limitative; the same purpose and the same advantages may be achieved by using a body in the shape of, for example, a parallelepiped, a pyramid, a cone or truncated cone, a cup, a tumbler, a bowl, a goblet, or similar variants.

Figure 9:
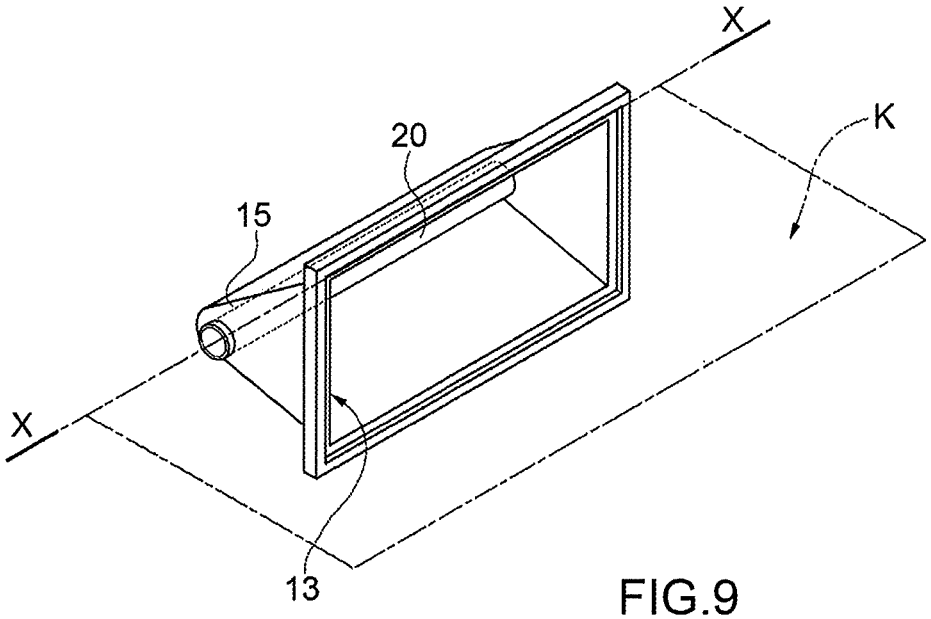
FIG. 9 shows a variant of the anchoring member, created in a single piece.

As shown schematically in FIG. 9, the anchoring member could be made entirely from one piece, for example by moulding or hot injection of a plastic material in a mould formed by two dies separable in a plane K, perpendicular to the plane of the mouth 13 and passing through the axis X-X of the anchoring bar 20. In such an anchoring member created from a single piece, the external sealing rings 30 and internal sealing rings 31 would not be necessary, since the sealing would be provided by the integral continuity of the moulded body.

Naturally, without prejudice to the principle of the invention, the forms of embodiment and the particulars of production may vary widely with respect to what is described and illustrated, without thereby departing from the scope of the invention.

The invention claimed is:

1. An anchoring member capable of being integrated into a facing element for creation of stabilized earth structures, comprising:

a shell defining a recess with a mouth, an anchoring bar extending transversely within the recess along a straight line and which is configured to receive an elongated stabilising member for stabilised earth structures inserted into the mouth, wherein the anchoring bar is tubular, so as to allow insertion of a straight rod element of a reinforcing grid therein.

2. The anchoring member according to claim 1, in which the anchoring bar is integral with the shell.

3. The anchoring member according to claim 1, in which the anchoring bar is inserted into two opposing holes provided on sides of the shell.

4. The anchoring member according to claim 3, in which extremities of the anchoring bar protrude laterally outside the shell.

5. The anchoring member according to claim 4, in which sealing rings are fitted on to the anchoring bar against the sides of the shell.

6. The anchoring member according to claim 1, in which the mouth is delimited peripherally by a protruding frame so as to form a peripheral supporting step.

7. The anchoring member according to claim 1, in which the mouth comprises housing means for a lid.

8. The anchoring member according to claim 1, in which the shell is defined by a constant-section curved wall with rounded apex opposite the mouth, delimited at extremities thereof by two flat side walls.

9. A facing element for a stabilised earth structure, comprising the anchoring member according to claim 1, and a visible front face and a rear face which is configured to be positioned in contact with a mass of earth, with the rear face being provided with the recess with the mouth, wherein the recess is configured to receive an elongated stabilised earth structure inserted into the mouth, and wherein the mouth is essentially in line with the rear face of the facing element.

10. The facing element according to claim 9, in which is embedded a reinforcing grid formed by rods forming a mesh, and at least one of the rods being inserted into the anchoring bar.

11. A former assembly for use with a stabilised earth structure, the former assembly comprising the facing element according to claim 9, and positioning and support members to support the anchoring member in a predetermined spatial position.

12. The former assembly according to claim 11, in which the positioning and support members comprise at least one pair of bars located at edges of the former assembly, the at least one pair of bars being provided with a respective series of holes for selective positioning of at least one supporting plate for the anchoring member.

13. A procedure for the fabrication of the facing element according to claim 9, using a former assembly including positioning and support members to support the anchoring member in a predetermined spatial position, comprising the following steps:

preparing the former assembly;

inserting into the former assembly a reinforcing grid consisting of rods that form a mesh, at least one of the rods being inserted into the anchoring bar of the anchoring member;

supporting the anchoring member by the positioning and support members fitted on to the former assembly;

pouring fluid concrete into the former assembly;

waiting for the concrete to set in the former assembly;

removing the positioning and support members; and removing the finished facing element from the former assembly.

* * * * *